US005562508A

United States Patent [19]

Rodskier et al.

[11] Patent Number: 5,562,508

[45] Date of Patent: Oct. 8, 1996

[54] MARINE PROPULSION ARRANGEMENT

[75] Inventors: Christian Rodskier, Torslanda, Sweden; Stig Johansson, Virginia Beach, Va.

[73] Assignee: AB Volvo Penta, Gothenburg, Sweden

[21] Appl. No.: 325,257

[22] PCT Filed: Apr. 23, 1993

[86] PCT No.: PCT/SE93/00356

§ 371 Date: Oct. 24, 1994

§ 102(e) Date: Oct. 24, 1994

[87] PCT Pub. No.: WO93/22193

PCT Pub. Date: Nov. 11, 1993

[30] Foreign Application Priority Data

Apr. 23, 1992 [SE] Sweden ..... 9201287

[51] Int. Cl.[6] ..... B63H 5/12

[52] U.S. Cl. ..... 440/061

[58] Field of Search ..... 440/49, 53, 57, 440/61, 75, 83

[56] References Cited

U.S. PATENT DOCUMENTS

| | | | |
|---|---|---|---|
| 3,888,203 | 6/1975 | Lohse . | |
| 4,545,770 | 10/1985 | Ferguson . | |
| 4,645,463 | 2/1987 | Arneson | 440/57 |
| 4,775,342 | 10/1988 | Conner et al. | 440/57 |
| 5,203,730 | 4/1993 | Kuragaki | 440/57 |
| 5,246,392 | 9/1993 | Johnston | 440/57 |

*Primary Examiner*—Stephen Avila
*Attorney, Agent, or Firm*—Young & Thompson

[57] ABSTRACT

Stern drive for boats, including a drive shaft housing rotatably journalled in a pivotal fork-shaped support bracket. Trim cylinders between a carrier on the boat transom and the support bracket, and steering cylinders between the support bracket and a cavitation plate on the drive shaft housing having engagement locations on the bracket, are situated in close proximity to each other.

4 Claims, 1 Drawing Sheet

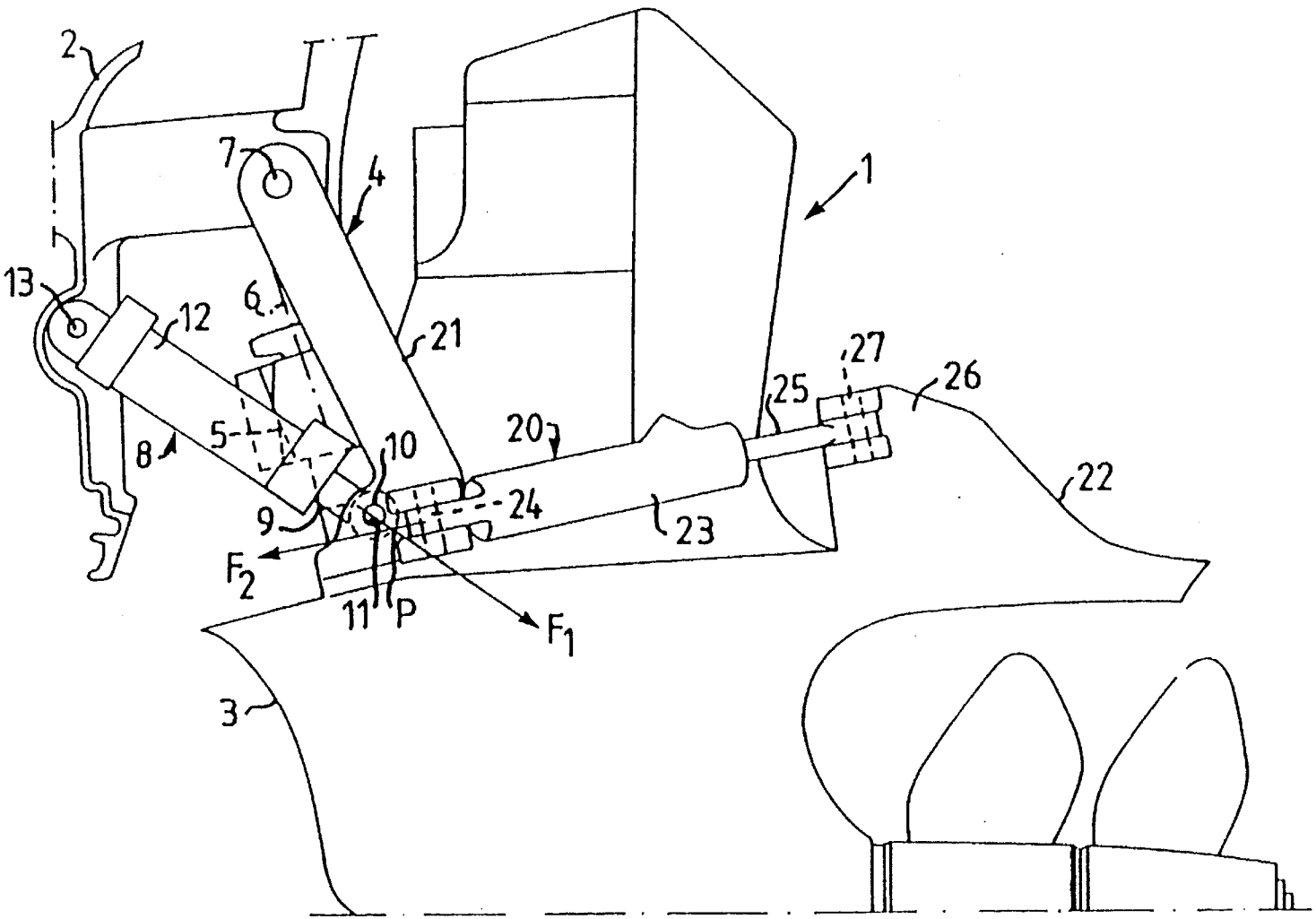
1
2
3
4
5
6
7
8
9
10
11
12
13
20
21
22
23
24
25
26
27
P
$F_1$
$F_2$

MARINE PROPULSION ARRANGEMENT

TECHNICAL FIELD

The present invention relates to a marine propulsion arrangement comprising a carrier which is intended to be affixed to a boat transom and a propeller drive shaft housing which is carried by a fork-shaped support bracket, shanks of which bracket are journalled to the carrier to permit pivotal movement of the support bracket about a pivot axis extending transversely to the drive shaft housing, said pivotal movement being effected by first pressure-responsive manoeuvring means, the drive shaft housing being journalled for pivotal movement relative to the support bracket about a substantially vertically disposed steering axis.

BACKGROUND OF THE INVENTION

Marine propulsion arrangements as described above come chiefly in two types, i.e. purely outboard motors in which the engine is rigidly connected to the upper end of the propeller drive shaft housing, and so-called stern drive installations in which a stern drive unit outboard of the transom is connected to a motor located inboard of the transom. In the first-mentioned type, the carrier is usually in the form of a clamp arrangement which clamps over an edge of the transom. The motor and drive shaft housing are carried by the fork-shaped support bracket. In the second type, the carrier is normally in the form of an attachment plate or frame which is mounted in an opening in the transom and to which the fork-shaped support bracket is pivotally journalled to impart pivotal movement to the drive shaft housing relative to the transom.

Particularly in stern drive installations, pivotal displacement of the drive shaft housing for steering purposes is achieved by rotation of a steering spindle to which a steering arm is affixed. The spindle is nonrotatably attached to the drive shaft housing and journalled in the support bracket. By means of a push-pull cable connected directly to the steering arm, or a hydraulic servo-unit, rotation of the steering wheel of the boat effects displacement of the steering arm, with consequential rotation of the steering spindle and displacement of the drive shaft housing relative to the transom. Due to the relatively short steering arm, in this type of construction high steering forces are required, particularly at high engine power levels, thereby leading to high stresses. The system must therefore be overdimensioned to prevent deflections and wear from becoming unacceptable.

In a known arrangement in which longer steering arms are employed in order to reduce the steering forces, use is made of a pair of hydraulic cylinders which are connected to the boat transom and regions of the propeller drive shaft housing at a distance from the steering spindle. Such an arrangement does however suffer from certain problems. The steering arrangement is not fully integrated in the propeller drive unit since one end of each hydraulic cylinder must be attached to the transom. The installation is therefore dependent on the form of the transom and the location of other possible components mounted thereon. The choice of attachment points on the transom is restricted since these should lie along the pivot axis for the trim displacement of the drive unit.

SUMMARY OF THE INVENTION

It is therefore a general object of the present invention to provide a marine propulsion arrangement of the type according to the preamble of claim 1 which comprises integrated hydraulic cylinders which provide an effectively longer steering arm and which do not need to be attached to the transom. In particular, it is an object of the invention to provide a propulsion arrangement which permits the transmission of very large steering forces to its support bracket which is attached to the transom without the need for any significant modifications to existing components.

This object is achieved in accordance with the present invention by means of second pressure-responsive manoeuvring means being connected between the fork-shaped support bracket and the propeller drive shaft housing for effecting pivotal movement of the drive shaft housing about the steering axis.

In a preferred embodiment, such an arrangement permits the first and second pressure-responsive manoeuvring means to be attached to the support bracket at points positioned closely to each other.

A propulsion arrangement of this type does not require any special attachment of steering system components to the boat transom. The connection of the steering cylinders to the shanks of the support bracket eliminates the dependence on the trim axis location, whereby the location of the steering cylinder arrangement close to the attachment points of the trim cylinders results in the smallest possible bending moment being induced by the steering forces on the support bracket.

BRIEF DESCRIPTION OF THE DRAWINGS

The invention will be described in greater detail in the following by way of example only and with reference to the attached drawing which shows a schematic elevational view of an embodiment of a stern drive unit according to the invention.

BEST MODE OF CARRYING OUT THE INVENTION

A stern drive unit of Aquamatic® type is shown in the drawing and comprises a carrier or frame 2 which is intended to be mounted on a transom and sealed around its edges in an opening in the transom (not shown). The drive unit includes a drive shaft housing 3 which is pivotally carried in a fork-shaped support bracket 4 via a spindle 5, the central axis 6 of which constitutes the steering axis of the drive unit. At its upper region, the support bracket is journalled to the carrier 2 to permit pivotal movement about a horizontal pivot axis 7. At its lower region, the support bracket engages with a pair of piston-cylinder units 8 arranged symmetrically about the axis 5 (only one unit is shown in the drawing). In the illustrated embodiment, the respective conrods 9 of the units 8 are pivotally connected to the support bracket 4 via a pin 10 in a through-hole 11 in each shank of the bracket, whilst each hydraulic cylinder 12 is pivotally connected to the carrier 2 via a pin 13. The piston-cylinder units 8 serve as so-called trim and tilt cylinders by means of which the angle of the drive shaft housing 3 can be trimmed when the boat is in motion and lifted out of the water when the boat is stationary.

For a more detailed description of the drive shaft housing 3 and its suspension, reference is made to Swedish patent application no. 8305060-9, which also illustrates an embodiment in which the trim and tilt cylinders are removable from the fork-shaped support bracket. Such an embodiment can provide an alternative to the above-described journalling via a pin 10 in a through-hole 11.

According to the invention, instead of using a steering arm having a single i inboard-mounted steering cylinder, two hydraulic cylinder units 20 symmetrically arranged with respect to the longitudinal plane of symmetry of the drive unit are pivotally connected to the lower end of each shank 21 of the support bracket 4 and to the cavitation plate 22 of the drive unit. In the shown embodiment, the cylinder 23 of each unit 20 is connected to its respective bracket shank 21 via a pivot pin 24, whilst the conrod 25 is connected to an attachment 26 on the cavitation plate via a pivot pin 27.

The cylinder units 20 serve as steering cylinders and are supplied with hydraulic fluid from a hydraulic pump (not shown) controlled by a steering wheel in such a manner that when a certain volume is supplied to the shown cylinder 23, a corresponding volume is drained from the not-shown opposite cylinder, thereby causing the drive unit to be rotated about the steering axis 6 through an angle corresponding to the volume. Due to the fact that the thrust component F1 of the trim cylinders 8 intersects the thrust component F2 of the steering cylinders 20 at a point P on respective shanks 21, very large forces can be tolerated since the shanks 21 are not subjected to any bending moments.

Within the scope of the invention and depending of the magnitude of the steering forces and the construction of the drive unit, the shown pair of single-action steering cylinders can be replaced by a double-action cylinder.

We claim:

1. In a marine propulsion arrangement comprising a carrier which is intended to be affixed to a boat transom and a propeller drive shaft housing which is carried by a support bracket, which bracket is journalled to the carrier to permit pivotal movement of the support bracket about a pivot axis extending transversely to the propeller drive shaft housing, said pivotal movement being effected by first pressure-responsive manoeuvering means, the propeller drive shaft housing being journalled for pivotal movement relative to the support bracket about a substantially vertically disposed steering axis; the improvement comprising second pressure-responsive manoeuvering means journalled to the support bracket and directly to the propeller drive shaft housing at a pivot point located at a stern region of the propeller drive shaft housing for effecting pivotal movement of the propeller drive shaft housing about the substantially vertically disposed steering axis, said pivot point being located a substantial distance astern of said steering axis.

2. Marine propulsion arrangement according to claim 1, wherein said first and second pressure-responsive manoeuvring means are attached to the support bracket at points positioned closely to each other.

3. Marine propulsion arrangement according to claim 1, wherein said second pressure-responsive manoeuvring means comprise hydraulic ram means.

4. Marine propulsion arrangement according to claim 3, wherein the hydraulic ram means has first end journalled in an attachment on the support bracket, and a second opposite end which is journalled to the drive shaft housing at a pivot point located at the stern region of a cavitation plate.

* * * * *